354-313 SR
7/7/87 OR 4,678,308

United States Patent [19]

Moss et al.

[11] Patent Number: 4,678,308

[45] Date of Patent: Jul. 7, 1987

[54] PROCESSING DEVICE

[75] Inventors: Brian F. Moss, Chelford; Richard J. Brent, Handforth, both of England

[73] Assignee: Ciba-Geigy AG, Basel, Switzerland

[21] Appl. No.: 832,938

[22] Filed: Feb. 26, 1986

[30] Foreign Application Priority Data

Mar. 7, 1985 [GB] United Kingdom ..... 8505843

[51] Int. Cl.[4] ..... G03D 13/06

[52] U.S. Cl. ..... 354/313; 354/329; 354/337

[58] Field of Search ..... 354/310, 312, 313, 314, 354/316, 323, 329, 330, 311, 335, 337

[56] References Cited

U.S. PATENT DOCUMENTS

| | | | |
|---|---|---|---|
| 2,781,708 | 2/1957 | Perlin | 354/311 |
| 3,605,601 | 9/1971 | Okayama et al. | 354/335 |
| 4,001,857 | 1/1977 | Ikechi et al. | 354/313 |
| 4,134,666 | 1/1979 | Kikuchi | 354/329 |
| 4,171,055 | 10/1979 | Lindgren | 414/412 |
| 4,514,070 | 4/1985 | Norris | 354/313 |
| 4,586,803 | 5/1986 | Moss et al. | 354/329 |

*Primary Examiner*—A. A. Mathews
*Attorney, Agent, or Firm*—Harry Falber

[57] ABSTRACT

An apparatus for the processing of a film contained in a cassette, the cassette being of the kind comprising a substantially cylindrical body formed with protruding light-tight longitudinally extending film exit slot means and having the film wound thereon, said apparatus comprising a light-tight columnar body having a longitudinal axis and a block accommodated by said columnar body having a central aperture for receiving the cassette and retaining the cassette body, and having a space sufficiently large to receive from said cassette the spool with the film wound thereon, and a plunger adapted for engaging the spool of said cassette and being movable to force the lowermost cap off said cassette body and to move said spool and the film wound thereon out of said cassette body and into said space, said space being adapted for containing liquid for processing the film, the apparatus being characterized in that there is present in the apparatus below the block, but above the space for containing liquid a shelf which is adapted to catch and retain the end cap as it is pushed off the cassette, the said shelf having in its middle a circular hole of sufficient diameter to allow passage threthrough of the film wound thereon the spool, but too small to allow the end cap to fall through the shelf.

3 Claims, 2 Drawing Figures

PROCESSING DEVICE

Figure 1:
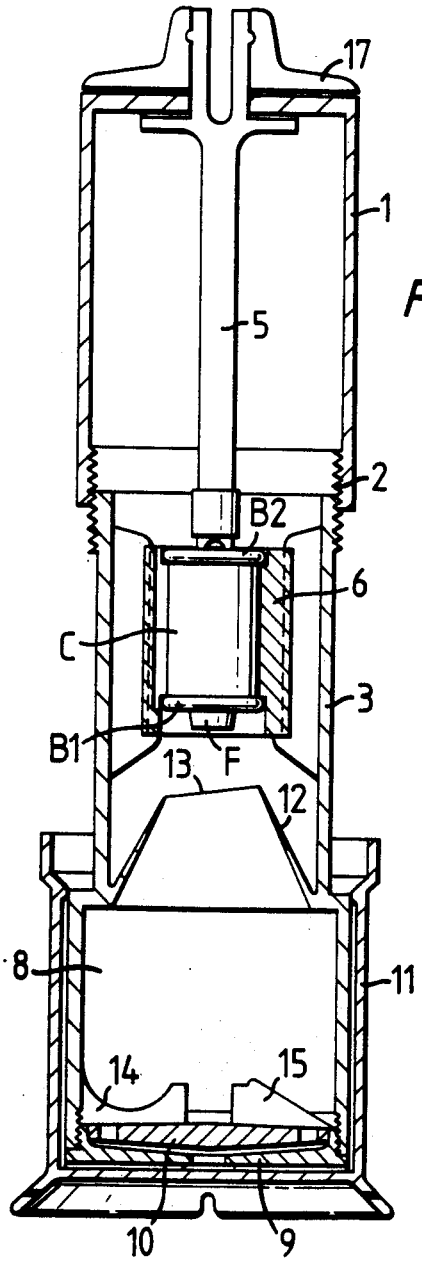

This invention relates to an apparatus for processing exposed lengths of photographic film material.

In our European patent application No. 84 810560.7 and now published application No. 147366 there is described apparatus for the processing of a film contained in a cassette. The cassette comprises a substantially cylindrical body formed with a light-tight, longitudinally extending film exit slot, end caps to the body and a spool held between the caps and having the film wound thereon. The apparatus comprises a light-tight enclosure, preferably in the form of a columnar body, provided with means shaped to receive and retain the cassette body provided with a space sufficiently large enough to receive from the cassette the spool with the film wound theron. A plunger is provided for engaging the spool of the cassette and for moving it to force an end cap off the cassette body and to move the spool and the film wound thereon into said space where the film can be treated with processing liquid. The processing liquid may be present in the space or can be introduced into it and drained from it through light-tight channels and/or passages. The plunger may pass through a lid of the enclosure or be fixed to it.

In FIG. 6 of this application No. 147366 an apparatus is shown in which the lowermost end cap of the cassette has been forced off the cassette and rests at the bottom of the space into which processing liquid is introduced.

However, it is undesirable to process flim in the presence of a metal end cap especially if the film is a colour film as the highly acidic or highly alkaline processing solutions tend to dissolve the metal of the end cap. This can cause staining of the film being processed and in some instances can even interfere with the photographic processing. Thus in FIG. 12 of application No. 147366 there is shown a modified apparatus in which provision is made to allow the forced-off end cap to escape from the apparatus. However, in practice it has been found difficult to get rid of the forced-off end cap out of the apparatus. We have now discovered a modification to the apparatus described in patent application No. 147366 in which the forced-off end cap is prevented from entering the space which holds the processing liquid in the apparatus.

Therefore according to the present invention there is described an apparatus for the processing of a film contained in a cassette, the cassette being of the kind comprising a substantially cylindrical body formed with protruding light-tight, longitudinally extending film exit slot means and having the film wound thereon, said apparatus comprising a light-tight columnar body having a longitudinal axis and a block accommodated by said columnar body having a central aperture for receiving the cassette and retaining the cassette body, and having a space sufficiently large to receive from said cassette the spool with the film wound thereon, and a plunger adapted for engaging the spool of said cassette and being movable to force the lowermost cap off said cassette body and to move said spool and the film wound thereon out of said cassette body and into said space, said space being adapted for containing liquid for processing the film, the apparatus being characterised in that there is present in the apparatus below the block, but above the space for containing liquid a shelf which is adapted to catch and retain the end cap as it is pushed off the cassette, the said shelf having in its middle a circular hole of sufficient diameter to allow passage therethrough of the film wound on the spool, but too small to allow the end cap to fall through the shelf.

Preferably the shelf is in the shape of a truncated cone with its smallest diameter end nearest the block.

Most preferably the end of the cone is cut off at an angle to help to ensure that the end cap slips off the cone and is retained by the shelf as it is pushed off the cassette.

The accompaning drawings will serve to illustrate the invention.

Figure 2:
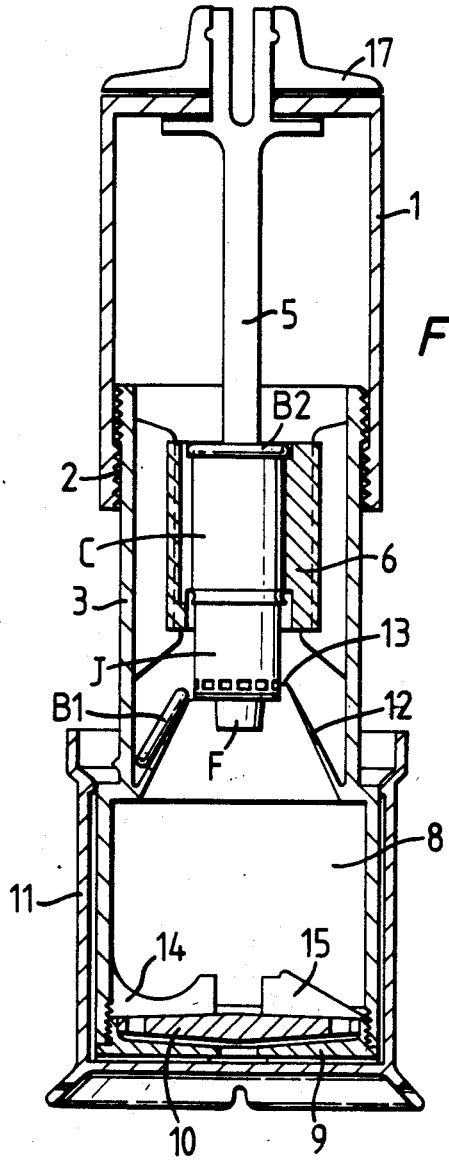

FIGS. 1 and 2 are cross-sectional side elevations of an apparatus according to the present invention.

The apparatus shown is a modification of the apparatus described and claimed in European patent application no. 84 810560.7.

In both figures the same numbers have the same signification.

In the figures the apparatus comprises a lid 1 which is connected by screw means 2 to a columnar body 3. Attached to the lid 1 is a plunger 5. Present in the columnar body 3 towards its open end is a block 6. Below the block 6 is a space 8 into which processing liquid can be introduced. Attached to the bottom of the columnar body 3 by screw means is a removable base 9 which comprises a labyrinth means for enabling processing solution to enter therein without the ingress of light. Columnar body 3 has been inserted into a wide bottomed procesing bath 11.

The sides of the bath 11 fit closely around the columnar body 3.

Present attached to the sides of the columnar body 3 and located below the block 6 and above the space 8 is a truncated cone shelf 12 which has in its centre a circular hole 13.

As shown in the Figures the top of the cone shelf 12 has been formed at an angle.

Attached to the floor of base 9 are two thin profile members. Member 14 which is concave in shape serves to bunch the convolutions of the film on the spool together. Member 15 serves to separate the film convolutions.

In FIG. 1 present in the block 6 is a loaded film cassette C having a top end cap B2 and a lower end cap B1.

In FIG. 2 the lid 1 has been screwed further into the columnar body 3. This has caused the plunger to paritally force the film J wound onto a spool out of the block 6. The end of the spool F is shown entering the truncated cone 12 through the circular hole 13 in the shelf.

The lower end cap B1 is shown retained in the outside of the shelf 12.

The operation of the apparatus is as described in European patent application no. 147366. In brief the columnar body is stood in the empty processing bath 11.

The lid 1 is screwed off the body 3 and a loaded cassette, with the film fully wound into it, is placed in the block 6. The end of the plunger 5 is fitted over the end of the spool and the lid 3 then screwed down onto the body. This forces the end cap B1 off the cassette C. In this case the end cap B1 is trapped by the shelf 12 and is prevented from falling into the liquid space 8. As the lid is continued to be screwed down the film J on the spool is forced out of the cassette C passing through the hole 13 in the shelf 12 and down into the space 8 and coming to rest so that the end of the spool is between the two members 14 and 15.

The columnar body 3 with lid 1 attached is then lifted out of the bath 11 and sufficient processing liquid to cover the whole of the film in the space 8 is then placed in the bath 11. The columnar body 3 plus the lid 1 is then carefully placed in the bath 11. The processing liquid is forced into the space through the liquid labyrinth system in the base 9.

The plunger 5 bearing at its end the wound film J on the spool 5 is caused to rotate by manually rotating the end 17 of the lid 1.

This rotation of the film J in the processing liquid causes the film convolutions continuously to contract and expand as the film is passed over the profile members 14 and 15.

After the requisite processing time the body 3 is lifted out of the bath 11 and the processing liquid flows out of the space 8 into the bath and is usually thrown away. Either another processing liquid is placed in the bath 11 or if a monobath has been used the base 9 is unscrewed from the body 3 and the film J removed from the body 3 for washing.

The lid 1 is then unscrewed from the body 3 and the block 6 is taken out and the cassette body is removed therefrom. The body 3 is then inverted to remove the end cap B1. Sometimes better processing is obtained if the processing liquid is present in space 8 before the film is pushed down into this space.

We claim:

1. An apparatus for the processing of film contained in a cassette, the cassette comprising a substantially cylindrical body formed with protruding light-tight longitudinally extending film exit slot means and having a top-most end cap and a lowermost end cap and accommodating a spool with the film wound thereon, said apparatus comprising a light-tight columnar body having a longitudinal axis and a block accommodated by said columnar body having a central aperture for receiving the cassette and retaining the cassette body, and having a space sufficiently large to receive from said cassette the spool with the film wound thereon, and a plunger adapted for engaging the spool of said cassette and being movable to force the lowermost cap off said cassette body and to move said spool and the film wound thereon out of said cassette body and into said space, said space being adapted for containing liquid for processing the film, the apparatus being characterised in that there is present in the apparatus below the block, but above the space for containing liquid, a shelf which is adapted to catch and retain the lowermost end cap as it is pushed off the cassette, the said shelf having in its middle a circular hole of sufficient diameter to allow passage therethrough of the spool with the film wound thereon, but too small to allow the end cap to fall through the shelf.

2. An apparatus according to claim 1 characterised in that the shelf is in the shape of a truncated cone with its smallest diameter nearest the block.

3. An apparatus according to claim 2 characterised in that the end of the cone is cut off at an angle to help to ensure that the end cap slips off the cone and is retained by the shelf as it is pushed off the cassette.

* * * * *